US011759019B2

(12) United States Patent
Billman

(10) Patent No.: US 11,759,019 B2
(45) Date of Patent: Sep. 19, 2023

(54) PRIVACY CHAIR ASSEMBLY

(71) Applicant: John Billman, East Troy, WI (US)

(72) Inventor: John Billman, East Troy, WI (US)

( * ) Notice: Subject to any disclaimer, the term of this patent is extended or adjusted under 35 U.S.C. 154(b) by 0 days.

(21) Appl. No.: 17/531,251

(22) Filed: Nov. 19, 2021

(65) Prior Publication Data

US 2023/0157454 A1 May 25, 2023

(51) Int. Cl.
*A47C 7/66* (2006.01)

(52) U.S. Cl.
CPC ..... *A47C 7/666* (2018.08)

(58) Field of Classification Search
CPC ..... A47C 7/666; A47C 7/66
USPC ..... 297/184.11, 184.14
See application file for complete search history.

(56) References Cited

U.S. PATENT DOCUMENTS 3,596,612 A * 8/1971 Sowder ..... B61B 12/002 104/173.2
4,131,312 A * 12/1978 Price ..... A47C 7/66 297/184.11
7,641,278 B2 * 1/2010 Strasser ..... B64D 11/0644 244/118.6
9,889,872 B2 * 2/2018 Somerset ..... B62B 9/14
10,494,101 B2 12/2019 Wilson
11,415,056 B1 * 8/2022 Yeung ..... F02C 6/00
2005/0248170 A1 * 11/2005 Kawamoto ..... B60N 2/793 296/24.34
2020/0331399 A1 * 10/2020 O'Connor ..... B60R 7/04

OTHER PUBLICATIONS

International Search Report and Written Opinion from PCT/US2022/079999 filed Nov. 17, 2022; 8 pages.

* cited by examiner

*Primary Examiner* — Sarah B Mcpartlin
(74) *Attorney, Agent, or Firm* — RYAN KROMHOLZ & MANION, S.C.

(57) ABSTRACT

A privacy device for use with an individual chair or seating arrangement. The privacy device has a pivotal interior lid that will allow the individual to have a visual and audio barrier while being seated in the chair. The lid can be held in various positions without the use of extraneous locking members.

15 Claims, 5 Drawing Sheets

PRIVACY CHAIR ASSEMBLY

BACKGROUND OF THE INVENTION

The present invention is directed towards chairs and related furniture that have privacy capabilities.

Often times a person will be seated in a crowded area or a public area that offer a lack of privacy. Generally this is not an issue, but there are times when a more secluded apace or area is desired. For example, in an airport, it could be desirous to have more privacy when a person wishes to sleep or work while waiting for a flight.

SUMMARY OF THE INVENTION

The present invention provides a privacy device for use with an individual chair or seating arrangement. The privacy device has a pivotal interior lid that will allow the individual to have a visual and audio barrier while being seated in the chair.

The present invention generally comprises a base connected to a hood. The hood is formed from an interior and exterior lid, with the interior lid pivotable from an open position to a closed position. The interior lid can be maintained at any position between the open and closed position without the need for a locking mechanism.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
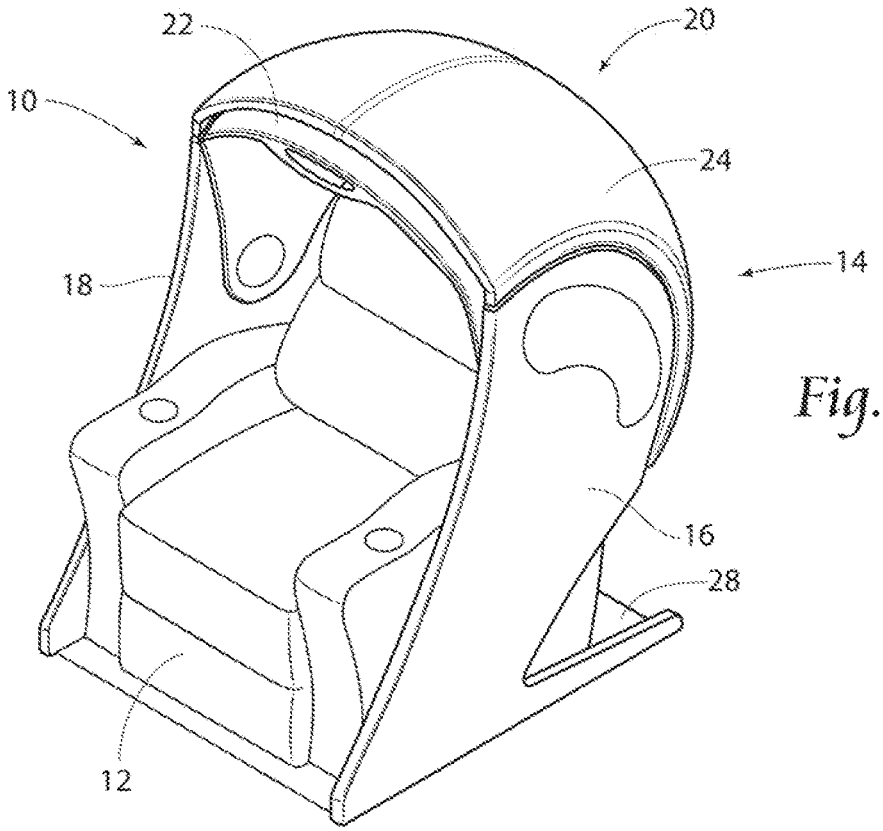
FIG. 1 is a perspective view of a privacy seat having a hood according to the present invention.

FIG. 1 depicts a privacy system 10 according to the present invention. The system 10 generally comprises a chair 12 and a support structure 14. The support structure 14 is designed to provide a privacy shroud for a person as they sit in the chair 12. That is, the support structure 14 provides an enclosure for a person when sitting in the chair. The support structure 14 has opposing sidewalls 16 and 13 and a hoed 20 connecting the sidewalls 16, 13. Unless otherwise indicated, description of various features of each of the sidewalls 16 and 13 are intended to refer to the other sidewall, as well. The hood 20 generally comprises an interior lid 22 end an exterior lid 24, which are pivotally connected to one another.

Figure 2:
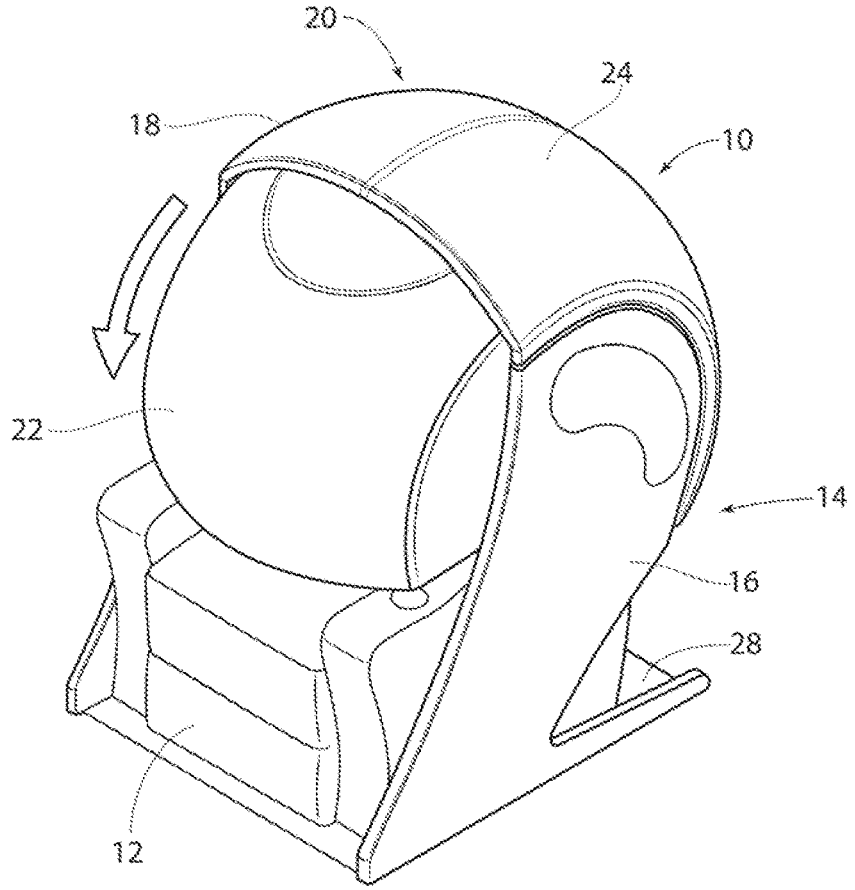
FIG. 2 is a perspective view of the seat of FIG. 1 with the hood in a closed position.

As shown in FIG. 2, the interior lid 22 is pivoted downwardly into a closed position from an open position (FIG. 1) Thus, the privacy system 10 allows the user to keep out external physical senses, such as sound and light when sitting m the chair 12.

Figure 3:
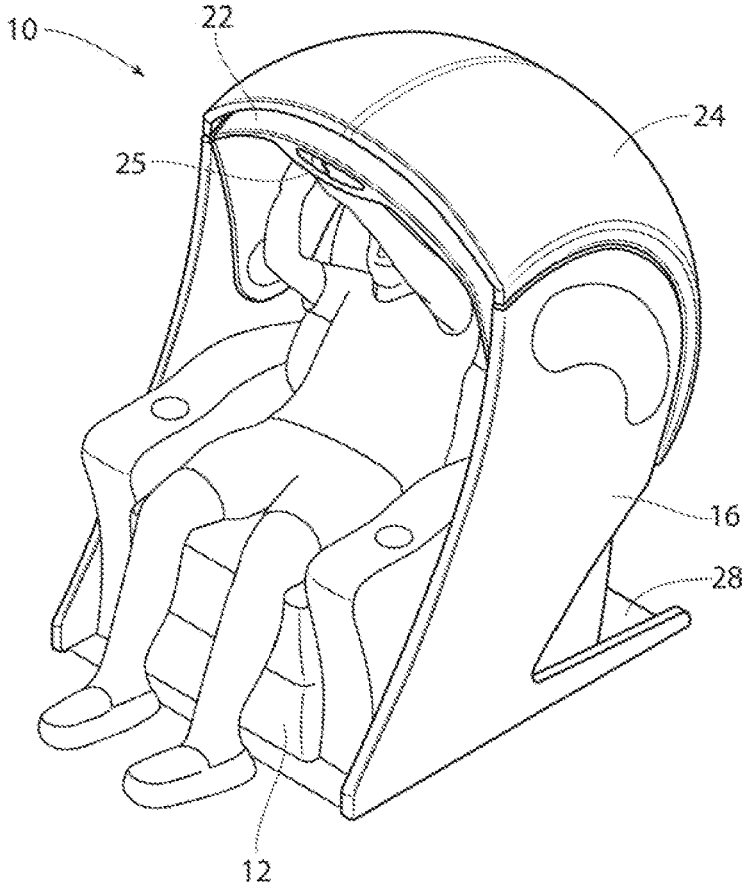
FIG. 3 is a perspective view of the seat in FIG. 1 with a person sitting in the seat.
Figure 4:
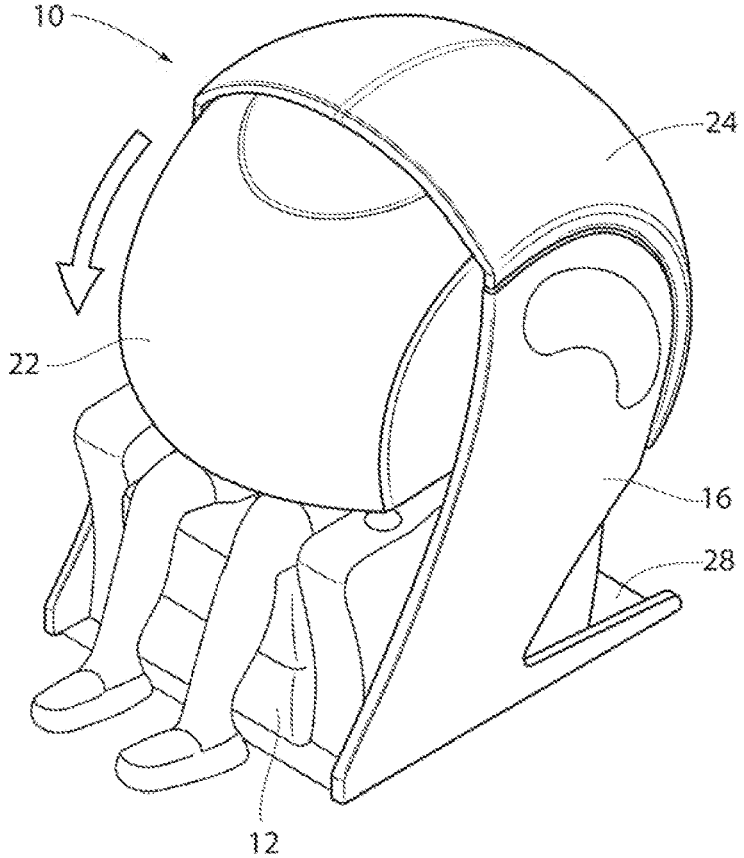
FIG. 4 shows the seat in FIG. 3 with the person moving the hood to a closed position.

FIGS. 3 and 4 demonstrate the support structure 14, designed with sufficient room to allow a person to sit in the chair 12 and move the interior lid 22 from an open position (FIG. 3) to a closed position (FIG. 4). The interior lid 22 can be moved by the person by gripping the interior lid 22, preferably by gripping a handle 25 located on the interior lid 22, and moving the user's arms in a downward direction. The handle 25 cars be of any design, such as a lip or bar that the user can grasp and position the interior lid 22. As will be appreciated, the user can easily glide the interior lid 22 between an open position (FIG. 3) and a closed position (FIG. 4) while retaining the interior lid at any position between the fully open and closed positions.

Figure 5:
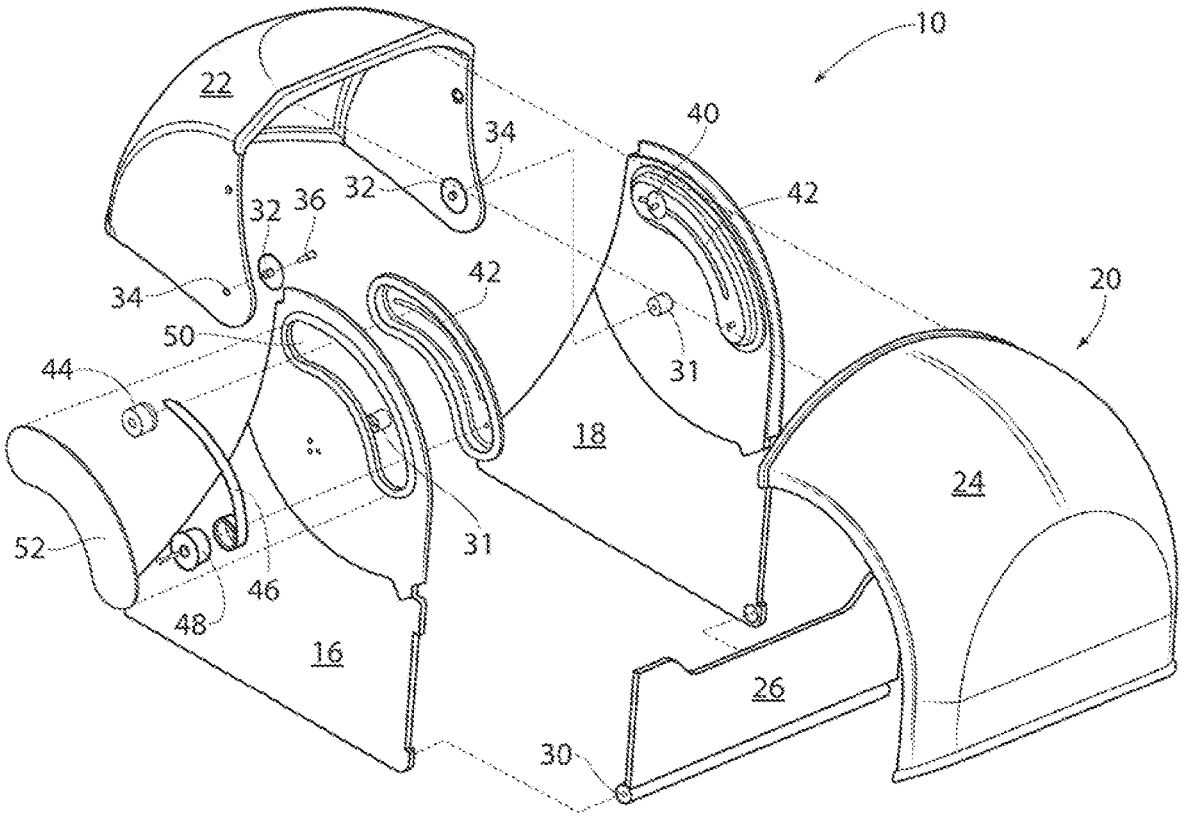
FIG. 5 is an exploded view of the invention shown in FIG. 1.

FIG. 5 is an exploded view of the system 10. The support structure 14 is preferably designed and formed from separate sections. That is, the hood 20, more specifically the exterior lid 24, and the side walls 16, 13 are preferably separate sections that; are attached to form the support structure 14, which can then be secured to one another. However, it is understood that; the support structure 14 could be designed as a single, integral structure. Furthermore, the support structure 14 could also comprise features for retaining the chair 12 within the support structure 14. The support structure 14 may comprise a rear backwall 26 and a bottom or base section 28 (see FIG. 4) that will be situated below the chair 12, if desired. The base section 28 may be used so that the chair 12 would be seated upon the system 10 and be moved together with the system 10. The rear backwall 26 can be connected to the sidewalls 16, 18 with the use of a support tube 30. The support tube 30 may be pivotally attached to the sidewalls 16, 18, so that the chair 12 could be slid into place within the structure 14. Provided the support, structure 14 forms a privacy shroud as discussed herein, the arrangement and design of the structure 14 would fall within the scope of the present invention.

As noted above, the interior lid 22 is pivotally connected to the structure 14. Specifically, the side walls 16, 18 comprise a respective pivot holder 31 that will mate with a pivot bushing 32, which will then be inserted into openings 34 located on the interior lid 22. The pivot holder 30 and bushing 32 will then be secured to one another with the use of a shoulder screw 36 or other similar fastening means.

The interior lid 22 is further connected to the sidewalls 16, 18 by way of respective adhesive nuts 40 that are situated within trackways 42 located on the sidewalls 16, 18. The adhesive nuts 40 and the trackway 42 form part of a sliding pulley system of the present invention. Preferably, there is a sliding pulley system located on each of the sides 16, 18 of the support structure 14, with each of the pulley systems being arranged in similar, opposing fashion. The sliding pulley system generally comprises the trackway 42, with the adhesive nut 40 mating with a movable spring coupler 44 and slidably secured within the trackway 42. The movable spring coupler 44 is attached to a spring band 46 that is further attached to a spool 46 and secured to the trackway 42. The spring band 46 is preferably made of a thin, metal material that will coil around the spool 4S. The trackway 42, coupler 44, spring band 46 and spool 46 are situated within a housing 50 and are enclosed with a cover plate 52.

Figure 5A:
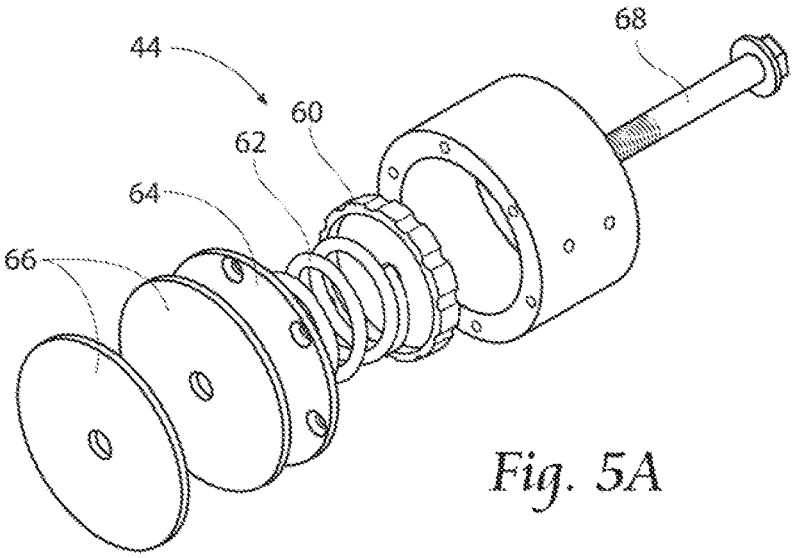
FIG. 5A is an exploded view of a gear assembly used in the present invention.

FIG. 5A is an up close view of the coupler 44, noted above. The coupler 44 houses a spring pad 60 and a spring 62, which ace secured within the coupler 44 with the use or a pad cover 64 that will be secured to the coupler 44 with the use of fasteners, such as screws or pins (not shown). Washers 66 will also be employed for proper biasing of the coupler 44. The entire assembly will be secured within the housing 50 located on the respective sidewalls 16, 18 (see FIG. 5) with the use of a fastener or a screw 66, e.g. a threaded head screw. The assembly will be further positioned and secured within the housing 50 in a manner that will assist in the positioning of the interior lid 22 and will allow the interior lid 22 to be held in various positions without pawls or other similar locking mechanisms.

Figure 6:
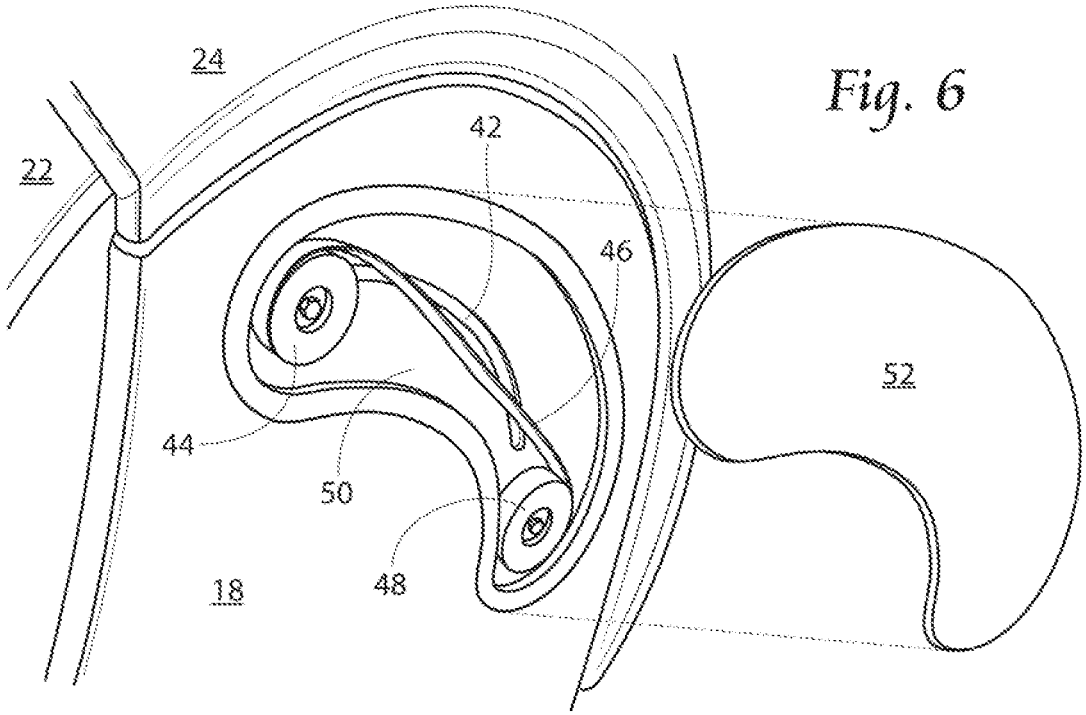
FIG. 6 is an exploded partial side view of the invention, showing the sliding mechanism of the present invention.

FIG. 6 shows a aide perspective view of the housing 50, with the cover plate 52 removed from the housing 50. The movable coupler 44, and the secured spool 4S are connected by spring band 46, with the spring band 46 being extended and uncoiled, in this arrangement, the interior lid 22 will be in a closed position, as demonstrated in FIGS. 2 and 4. The movable coupler 44 could be considered a movable wheel in the pulley system, and the secured spool could be considered a fixed wheel in the general description of the present system.

Figure 7A:
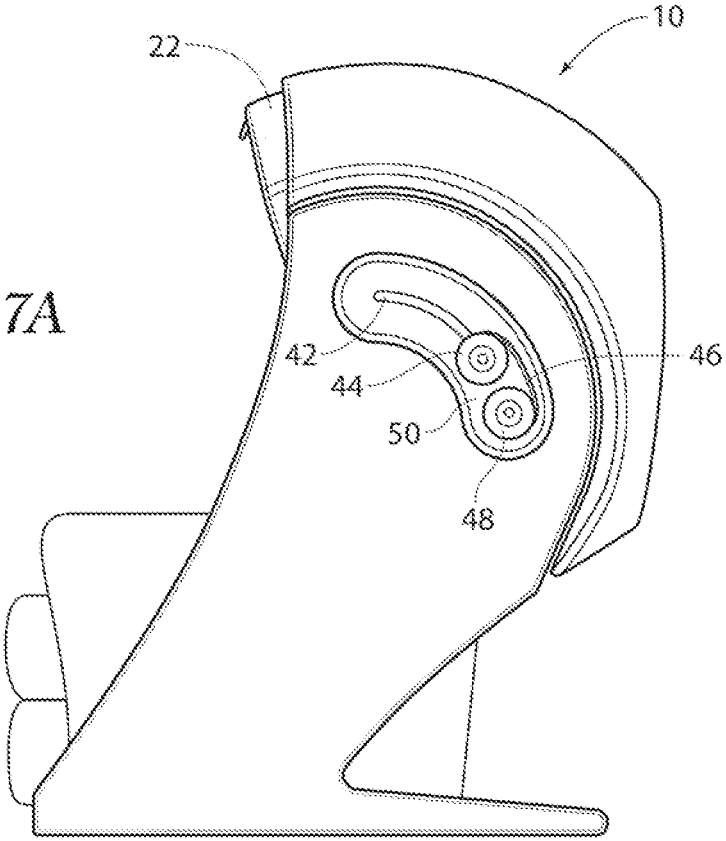
FIG. 7A depicts a side view of the invention in an open position.
Figure 7B:
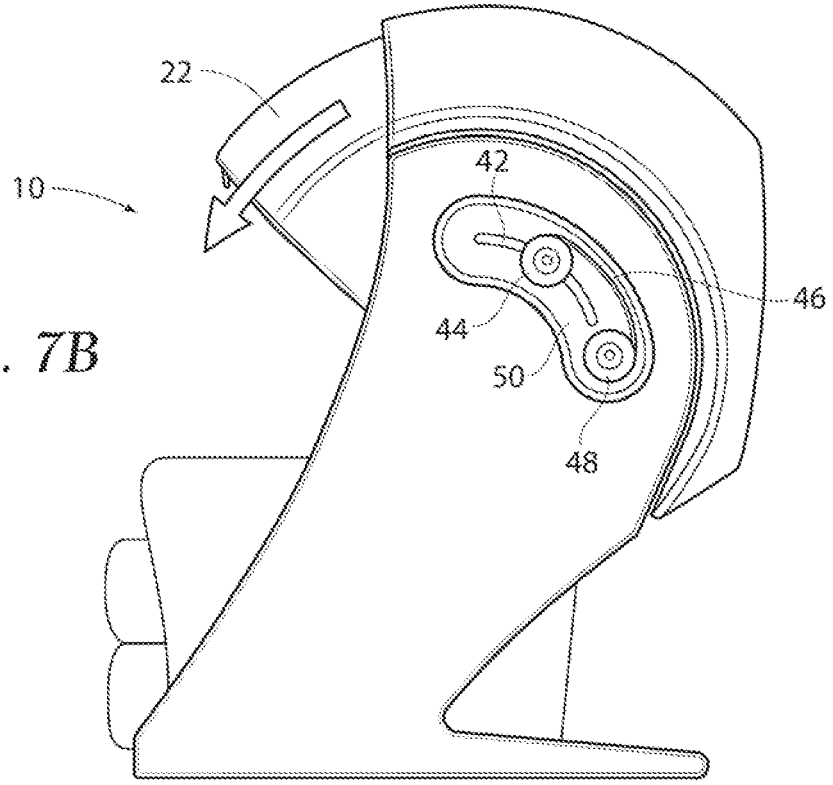
FIG. 7B depicts a side view of the invention in a partially closed position.
Figure 7C:
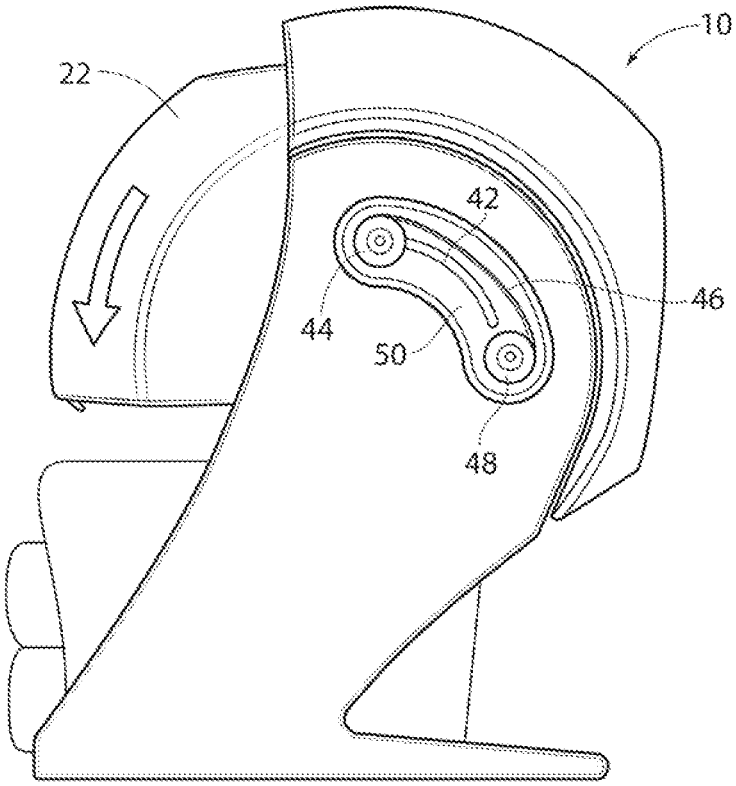
FIG. 7C depicts a side view of the invention in a closed position.

As is demonstrated in FIGS. 7A-7C, the movable coupler 44 slides along the trackway 42 as the interior lid 22 moves between a closed position (FIG. 7C) and open position (FIG. 7A). The arrangement is designed so that the interior lid 22 may be put in any position between open and closed and remain at that position. For example, as shown in FIG. 7B, the interior lid 22 is in a partially closed position, with the movable coupler 44 positioned along the length of the trackway 42. Because of the arrangement of the coupler 44, spool, 48 and the band 46, the interior lid 22 can be maintained in the position shown in FIG. 7B without, requiring any external force, such as a locking mechanism, ratcheting mechanism, the user's hand, or a pawl arrangement.

The system and devices or the present invention provide a unique personal privacy arrangement, for various uses. For example, the present invention could be employed and used during a flight for a person to get some rest or possibly in a public setting, such as a park bench, wherein a person may wish to have some privacy or a barrier so that they may be able to read a message, e-mail, etc., from a screen that may not be easily read outside in the sunlight. The system may also be utilized in a lecture hall or similar room, wherein individual media or audio may be sent to an individual privacy system 20. That is, the internal wall of the interior lid 22 could be used as a video screen or speakers could be arranged within the privacy system 10. Provided that a system is designed according to the present invention that provides a movable and adaptable privacy Arrangement, it is understood that the location would not be determinative of the scope of the invention.

The foregoing is considered as illustrative only of the principles of the invention. Furthermore, since numerous modifications and changes; will readily occur to these skilled in the art, it is not desired to limit the invention to the exact construction and operation shown and described. While the preferred embodiment has been described, the details may be changed without departing from the invention, which is defined by the claims.

I claim:

1. A privacy device for use with a chair, said privacy device comprising:

a base;

a hood connected to said base, said hood comprising an exterior lid and an interior lid;

said interior lid pivotally connected to exterior lid, said interior lid movable between an open position and a closed position a pulley system for moving the interior lid between said open and said closed position, said pulley system comprising a fixed wheel and a movable wheel, said wheels connected by a band.

2. The privacy device of claim 1 further comprising a trackway for said movable wheel to slide along.

3. The privacy device of claim 2, wherein said band is capable of coiling around at least one of said wheels.

4. The privacy device of claim 2 wherein said interior lid is capable of being retained in any position between said open and said closed position without a locking mechanism.

5. The privacy device of claim 1 wherein said base and said exterior lid are designed as an integral arrangement.

6. A privacy device for use with a chair, said privacy device composing:

a support structure, said support structure comprising a a first side wall;

a second side wall;

an exterior lid connecting said first side wall and said second side wall;

an interior lid pivotally connected to said support structure, said interior lid slidably movable between an open position and a closed position, and a pulley system, said pulley system comprising:

a housing located on one of said side walls;

a trackway located within said housing;

a movable spring coupler positioned within said trackway;

a secured spool located within said trackway;

a spring band connecting said movable spring coupler and said secured spool, said spring band coilable around at least one of said movable spring coupler and said secured spool;

wherein said pulley system allows for said interior lid to be securely positioned at any position between said open and said closed position.

7. The privacy device of claim 6, further comprising a pulley system in each of said side walls.

8. The privacy device of claim 6 further comprising a backwall connected to each of said side walls.

9. The privacy device of claim 6, further comprising a base section connected to said side walls.

10. A privacy device for use with a chair, said privacy device comprising a base;

an interior lid;

said interior lid pivotally connected to said base, said interior lid movable between an open position and a closed position, wherein said interior lid is capable of being held in an intermediate position between said open and closed position without a locking mechanism;

a pulley system for moving said interior lid between said open and said closed position, said pulley system comprising a fixed wheel and a movable wheel, said wheels connected by a band.

11. The privacy device of claim 10 wherein said base comprises a pair of sidewalls connected by an exterior lid.

12. The privacy device of claim 10 further comprising a housing located in said base, said pulley system located in said housing.

13. The privacy device of claim 12 further comprising a trackway located said housing, said pulley system located on said trackway.

14. The privacy device of claim 12, wherein said band capable of coiling around at least on of said fixed wheel and said movable wheel.

15. The privacy device of claim 14 comprising a pair of pulley systems oppositely disposed on said base.

* * * * *